US012290125B2

(12) United States Patent
Hoshizaki et al.

(10) Patent No.: US 12,290,125 B2
(45) Date of Patent: May 6, 2025

(54) HEAD PROTECTION FOR REDUCING ANGULAR ACCELERATIONS

(71) Applicant: MIPS AB, Täby (SE)

(72) Inventors: Thomas Blaine Hoshizaki, Rockcliffe Park (CA); Andrew Michael Post, Ottawa (CA); Philippe Rousseau, Ottawa (CA)

(73) Assignee: MIPS AB, Täby (SE)

( * ) Notice: Subject to any disclaimer, the term of this patent is extended or adjusted under 35 U.S.C. 154(b) by 179 days.

(21) Appl. No.: 16/429,374

(22) Filed: Jun. 3, 2019

(65) Prior Publication Data

US 2019/0350298 A1 Nov. 21, 2019

Related U.S. Application Data

(63) Continuation of application No. 13/739,699, filed on Jan. 11, 2013, now Pat. No. 10,306,942.

(60) Provisional application No. 61/585,976, filed on Jan. 12, 2012.

(51) Int. Cl.
*A42B 3/12* (2006.01)
*A42B 3/06* (2006.01)

(52) U.S. Cl.
CPC ..... *A42B 3/12* (2013.01); *A42B 3/064* (2013.01); *A42B 3/121* (2013.01)

(58) Field of Classification Search
CPC ..... A42B 3/121; A42B 3/064; A42B 3/12
USPC ..... 2/413
See application file for complete search history.

(56) References Cited

U.S. PATENT DOCUMENTS

| | | | | |
|---|---|---|---|---|
| 3,254,883 | A * | 6/1966 | Morgan | A42B 3/12 267/141 |
| 3,600,714 | A | 8/1971 | Cade et al. | |
| 3,609,764 | A | 10/1971 | Morgan | |
| 3,761,959 | A | 10/1973 | Dunning | |
| 4,023,213 | A | 5/1977 | Rovani | |
| 4,375,108 | A | 3/1983 | Gooding | |
| 6,434,755 | B1 * | 8/2002 | Halstead | A42B 3/128 2/413 |
| 6,560,787 | B2 | 5/2003 | Mendoza | |
| 6,658,671 | B1 | 12/2003 | Holst et al. | |
| 7,103,923 | B2 | 9/2006 | Picotte | |
| 7,930,771 | B2 | 4/2011 | Depreitere et al. | |
| 8,665,861 | B1 | 3/2014 | Bajpay et al. | |

(Continued)

FOREIGN PATENT DOCUMENTS

WO 2013/000095 A1 1/2013

*Primary Examiner* — Alissa J Tompkins
*Assistant Examiner* — Catherine M Ferreira
(74) *Attorney, Agent, or Firm* — Husch Blackwell LLP

(57) ABSTRACT

Safety head wear for use for example in high risk activities such as sports and industrial purposes where protection from head injuries is required. Components are provided inserted between the liner and outer shell and consists of two parts; a chamber or bladder and a fluid or gel like material. The fluid or gel material is contained in the chamber or bladder and is positioned in such a way to create low friction between the surface of the shell and liner or liner and head. It can also be used on the outer surface of the shell or placed within two layers of the liner. The device provides a method of independently managing both compression and shear force characteristics of the helmet around the head designed to decrease brain trauma resulting from high linear and angular acceleration during impacts to the helmet.

15 Claims, 4 Drawing Sheets

(56) References Cited

U.S. PATENT DOCUMENTS

| | | | | |
|---|---|---|---|---|
| 2001/0032351 | A1 | 10/2001 | Nakayama et al. | |
| 2004/0117896 | A1 | 6/2004 | Madey et al. | |
| 2004/0168246 | A1 | 9/2004 | Phillips | |
| 2007/0000025 | A1* | 1/2007 | Picotte | A42B 3/121 2/171 |
| 2007/0190293 | A1* | 8/2007 | Ferrara | B32B 27/065 428/166 |
| 2008/0155735 | A1* | 7/2008 | Ferrara | A01N 25/34 2/412 |
| 2011/0252544 | A1* | 10/2011 | Abernethy | A42B 3/122 2/413 |
| 2012/0297526 | A1* | 11/2012 | Leon | A63B 71/10 2/413 |
| 2014/0189945 | A1 | 7/2014 | Golnaraghi et al. | |
| 2016/0120256 | A1 | 5/2016 | Golnaraghi et al. | |

* cited by examiner

FIG. 6
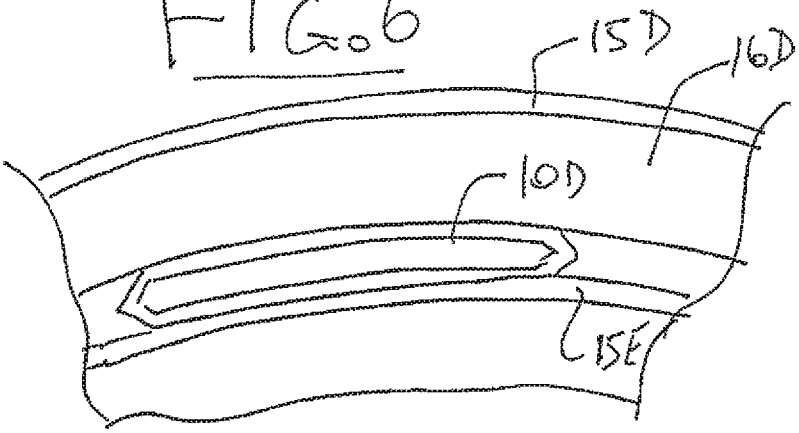
FIG. 7
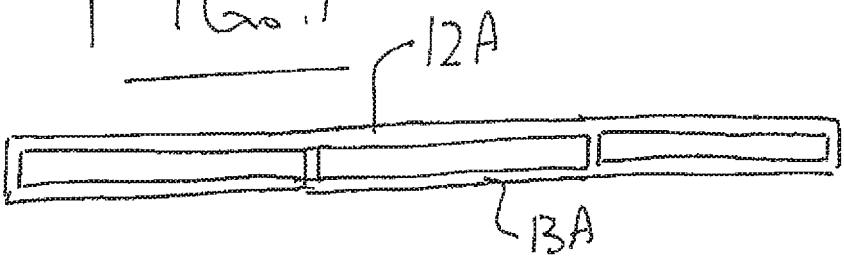
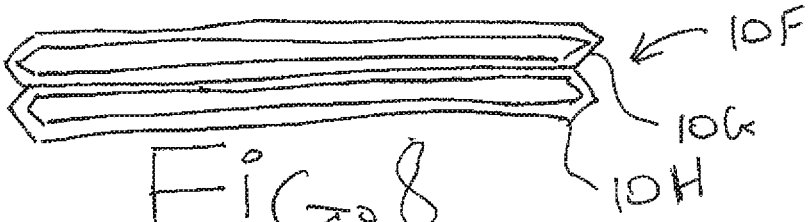
FIG. 8
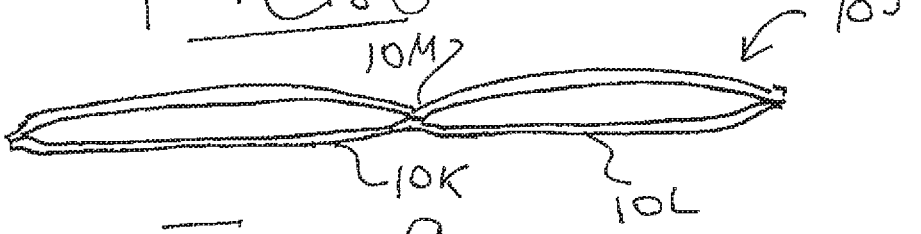
FIG. 9

HEAD PROTECTION FOR REDUCING ANGULAR ACCELERATIONS

This application is a continuation application of U.S. application Ser. No. 13/739,699, filed Jan. 11, 2013, which will issue as U.S. Pat. No. 10,306,942 on Jun. 4, 2019, which claims the benefit under 35 USC 119(e) of Provisional Application 61/585,976, filed Jan. 12, 2012, the entire disclosures of which are herein incorporated by reference for all purposes.

This invention relates to safety head wear for use in high risk activities such as sports and industrial purposes where protection from head injuries is required and particularly to an arrangement for reducing angular forces on the head of the wearer caused by angular acceleration from an impact.

BACKGROUND OF THE INVENTION

Head injuries in sport have been described as an epidemic especially in contact sports like football, hockey and lacrosse. While catastrophic head and brain injuries are generally managed effectively, helmets have had little effect on the incidence of concussive injuries. In part this is the result of helmets used in sport, recreational pursuits and industry having primarily been designed to prevent catastrophic head injuries. Head injuries resulting from direct impacts are characterized by both linear and angular accelerations of the head during the impact. Certain types of head injuries like skull fractures and intracranial bleeds are associated with linear accelerations while injuries like concussions and subdural hematomas are though to be more closely associated with angular accelerations. Present day foams and plastic structures used in helmets have been developed to primarily manage linear accelerations, but there are few inventions directed at managing both linear and angular accelerations.

One arrangement intended to reduce such angular accelerations is disclosed in U.S. Pat. No. 6,560,787 issued May 2003 by Mendoza which describes a layer of gel contained between two rigid bodies designed to attenuate both compressive and angular forces acting on the head. This arrangement cannot provide the reduction in angular forces sufficient to prevent head trauma.

SUMMARY OF THE INVENTION

It is one object of the invention to provide an improved helmet which provides an arrangement to manage angular forces on the head of the wearer.

According to one aspect of the invention there is provided headwear used for protection of the head from impacts to the head comprising:

- an inner layer for engaging an outer surface of the head of the wearer;
- an outer layer for impacting exterior objects;
- a plurality of components located between the inner layer and the outer layer and arranged at spaced positions around the head of the wearer;
- each of the components being arranged to allow relative movement between the outer surface of the head and the outer layer in a direction generally parallel to the outer surface of the head.

Preferably each component is arranged to accommodate angular forces applied between the head and the outer layer.

Preferably the headwear is arranged to accommodate both linear and angular forces applied between the head and the outer layer.

Preferably there is provided a stiff inner liner at the inner layer for engaging the outer surface of the head and there is provided a rigid outer shell at the outer layer and wherein there is provided a collapsible material between the inner liner and the outer shell for absorbing the linear forces applied between the head and the outer layer.

The components can be arranged either at or adjacent the outer shell or at or adjacent the inner liner.

Preferably the components are arranged between the inner liner and the outer shell.

In some cases the outer layer may not include an additional rigid shell.

Where it is required to also accommodate linear forces a collapsible material can be provided to accommodate those linear forces.

Preferably the collapsible material is provided as a layer separate from the components. The collapsible material can be a resilient material such as a resilient foam material.

In some cases the headwear does not have a structure to manage linear acceleration and only has a rotational management system provided by the components.

Preferably each of the components comprises a container having an outer wall and an inner wall with a flowable material therebetween such that the outer wall can slide relative to the inner wall in a direction generally parallel to the walls. In this case the container can be formed of a material providing flexible walls and/or elastic walls.

Preferably the component allows collapse movement in a direction at right angles to the surface of the head by displacing the flowable material to sides.

The flowable material can be a gel or a liquid, typically although not necessarily a Newtonian fluid.

Preferably there is provided at least one component between each of the top, front, rear, left side and right side of the outer surface of the head of the wearer and the associated part of the outer layer where the components are separated by a space each from the next.

According to a second aspect of the invention there is provided headwear used for protection of the head from impacts to the head comprising:

- an inner layer for engaging an outer surface of the head of the wearer;
- an outer layer for impacting exterior objects;
- at least one component located between the inner layer and the outer layer;
- wherein said at least one component comprises a container having an outer wall and an inner wall with a flowable material therebetween such that the outer wall can slide relative to the inner wall in a direction generally parallel to the walls.

The arrangement as described in more detail hereinafter relates to safety head wear for use in high risk activities such as sports and industrial purposes where protection from head injuries is required.

It includes between inner and outer layers two parts; a chamber or bladder and a fluid or gel-like material. The fluid or gel material is contained in the chamber or bladder and is positioned in such a way to create low friction between the surface of the shell and liner or liner and head. It can also be used on the outer surface of the shell or placed within two layers of the liner.

The device provides a method of managing both compression and shear force characteristics of the helmet around the head designed to decrease brain trauma resulting from high linear and angular acceleration during impacts to the helmet. The device consists of a chamber or bladder that is filled with a fluid or gel chosen to define the friction between the inside surfaces of the chamber or bladder. The structure and materials are used to design the appropriate mechanical characteristics for each application and defined impact. The resulting effect of the device is to decrease both linear and angular acceleration thus decreasing the risk of head and brain injuries associated with these forces. The invention can be used in conjunction with traditional materials and structures or on its own depending on the needs of the helmet.

This device is intended to manage the forces resulting from an impact to the head by decreasing the resulting linear and angular accelerations of the head.

Specifically the arrangement described herein provides a means to manage the angular forces independently from linear forces during an impact to the head. This invention can be used but is not limited to helmets used in sport like hockey, football, lacrosse, alpine skiing, cycling and motor sport as well as safety helmets for industrial and transportation applications.

The example described hereinafter demonstrates the use of the device in an ice hockey helmet. In this example the device can be positioned either between the liner and the shell or the liner and the surface of the head. The device is made up of a series of flexible bladders at spaced positions around the head of the wearer, each containing a low friction liquid or gel. This device allows the outer surface of the helmet to move parallel to the surface of the head of the wearer in a controlled fashion to decrease both linear and angular acceleration of the head.

The above Mendoza patent describes a layer of gel contained between two rigid bodies designed to attenuate both compressive and angular forces acting on the head. The present invention is intended to use a chamber or bladder with a low friction liquid or gel to manage the angular forces separately from the compressive forces. With a gel material such as in Mendoza the compressive and angular forces are managed by one material and cannot be managed separately. This is important because the angular forces are unique and not necessarily similar to the compressive forces requiring a method of managing the angular forces separate from the compressive forces.

Direct impacts to the head provide impacts that are the result of a moving object contacting the head as in an elbow of a player impacting a stationary player's head or a tackler's helmet impacting a stationary player's helmet or when the head is moving and comes in contact with a stationary object. For example when a person falls to the ground and the head is moving until it comes in contact with the stationary ground.

Linear acceleration occurs when an object with mass and velocity contacts the head or the head is moving with mass and velocity and the resulting acceleration from the impact is in a linear or straight manner.

Angular acceleration occurs when an object with mass and velocity contacts the head or the head is moving with mass and velocity and the resulting acceleration from the impact is angular or not in a straight manner.

Protective headwear as defined herein includes any headwear designed to be worn to decrease the risk of a head injury. Most commonly used in sporting activities and industrial applications.

A helmet as defined herein comprises protective headwear used to protect wearers from hazards generally made up of as shell, liner and retention system.

A shell as defined herein comprises the outer layer of a helmet generally consisting of a harder material and is often designed to distribute the force over a larger area. It is generally made up of harder materials like polycarbonate, polyethylene or composite materials.

A liner as defined herein comprises the part of the helmet that is primarily responsible for the energy management of a helmet and can be made up of vinyl nitrile or polystyrene or polypropylene foams, or plastic structures or any combination of the above designed to absorb energy.

Friction defines the mechanical relationship between two materials and is the force resisting the relative motion of solid surfaces, fluid layers, and/or material elements sliding against each other. There are several types of friction: Dry friction resists relative lateral motion of two solid surfaces in contact. Dry friction is subdivided into static friction between non-moving surfaces, and kinetic friction between moving surfaces. Fluid friction describes the friction between layers within a viscous fluid that are moving relative to each other. Lubricated friction is a case of fluid friction where a fluid separates two solid surfaces. The arrangement as described herein uses the fluid friction to control the relative sliding movement of the two layers of the chamber or bladder to absorb the energy from the angular acceleration.

A chamber or bladder as used herein is a device that contains a substance that can be designed to stretch with the movement of the substance or change the mechanical response of the substance to force. This device can be a single or multiple chambered device to create a variety of effects.

A gel as defined herein includes a substantially dilute cross-linked system, which exhibits no flow when in the steady-state. By weight, gels are mostly liquid, yet they behave like solids due to a three-dimensional cross-linked network within the liquid. It is the cross links within the fluid that give a gel its structure (hardness) and contribute to stickiness (tack). In this way gels are a dispersion of molecules of a liquid within a solid in which the solid is the continuous phase and the liquid is the discontinuous phase.

A fluid as defined herein can be either Newtonian or non-Newtonian. A Newtonian fluid as defined herein is a fluid whose stress versus strain rate curve is linear and passes through the origin. The constant of proportionality is known as the viscosity. A non-Newtonian fluid as defined herein is a fluid whose flow properties differ in any way from those of Newtonian fluids. In a non-Newtonian fluid, the relation between the shear stress and the shear rate is different, and can even be time-dependent. Therefore, a constant coefficient of viscosity cannot be defined.

Shear forces are the component of stress coplanar with a material cross section. Shear stress arises from the force vector component parallel to the cross section.

Compression forces or normal forces arise from the force vector component perpendicular to the material cross section on which it acts.

BRIEF DESCRIPTION OF THE DRAWINGS

One embodiment of the invention will now be described in conjunction with the accompanying drawings in which:

FIG. 6 is a cross-sectional view similar to that of FIG. 3 showing a third alternative embodiment.

FIG. 7 is a cross-sectional view of one bladder for use in the helmet of FIG. 1 showing a first alternative embodiment.

FIG. 8 is a cross-sectional view of one bladder for use in the helmet of FIG. 1 showing a second alternative embodiment.

FIG. 9 is a cross-sectional view of one bladder for use in the helmet of FIG. 1 showing a third alternative embodiment.

In the drawings like characters of reference indicate corresponding parts in the different figures.

DETAILED DESCRIPTION

A chamber or bladder provided herein consists of one or more compartments to contain the liquid or gel and provides structure to manage both compressive and shear forces resulting from an impact.

A liquid or gel like material 11 is provided in the bladder that decreases the shear forces between the helmet and the surface of the head.

The liquid or gel material 11 allows flexible inner and outer walls 12, 13 to float or slide relative to one another in a direction parallel to the wall and to the surface 14 of the head of the wearer.

This device is intended to manage the forces resulting from an impact to the head by decreasing the resulting linear and angular accelerations of the head. Specifically this invention provides a means to manage the angular forces independently from linear forces during an impact to the head. This invention can be used but is not limited to helmets used in sport like hockey, football, lacrosse, alpine skiing, cycling and motor sport as well as safety helmets for industrial and transportation applications.

Figure 1:
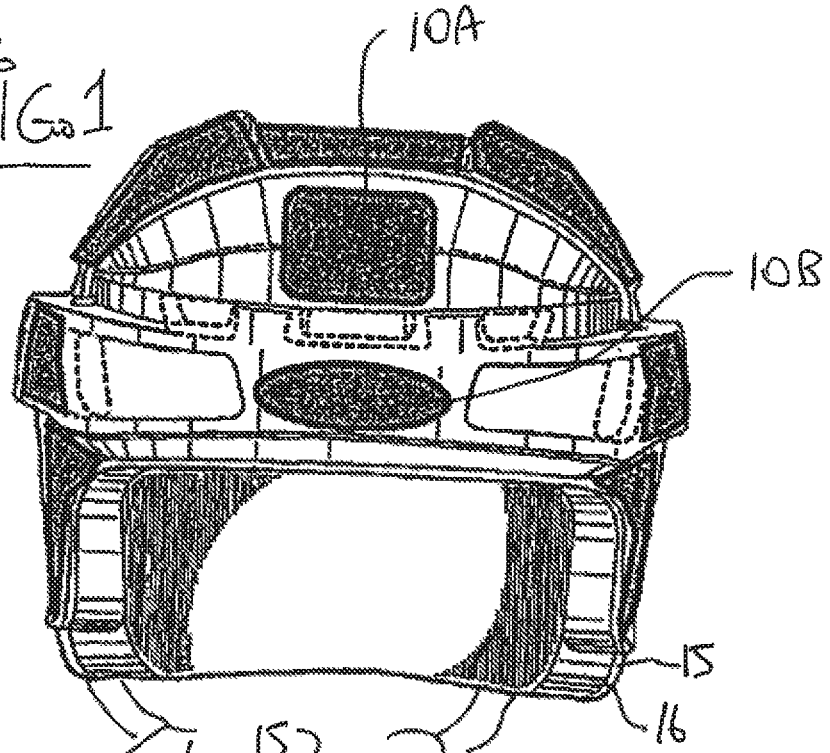
FIG. 1 is a front elevational view of an ice hockey helmet according to the present invention showing placement of the bladders.
Figure 2:
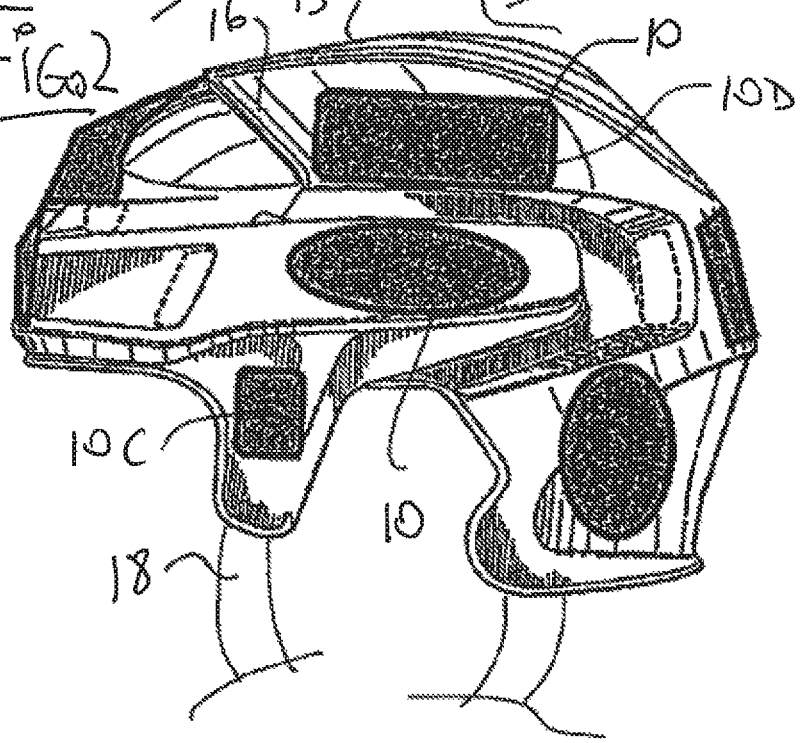
FIG. 2 is a front elevational view of an ice hockey helmet according to the present invention showing placement of the bladders.
Figure 3:
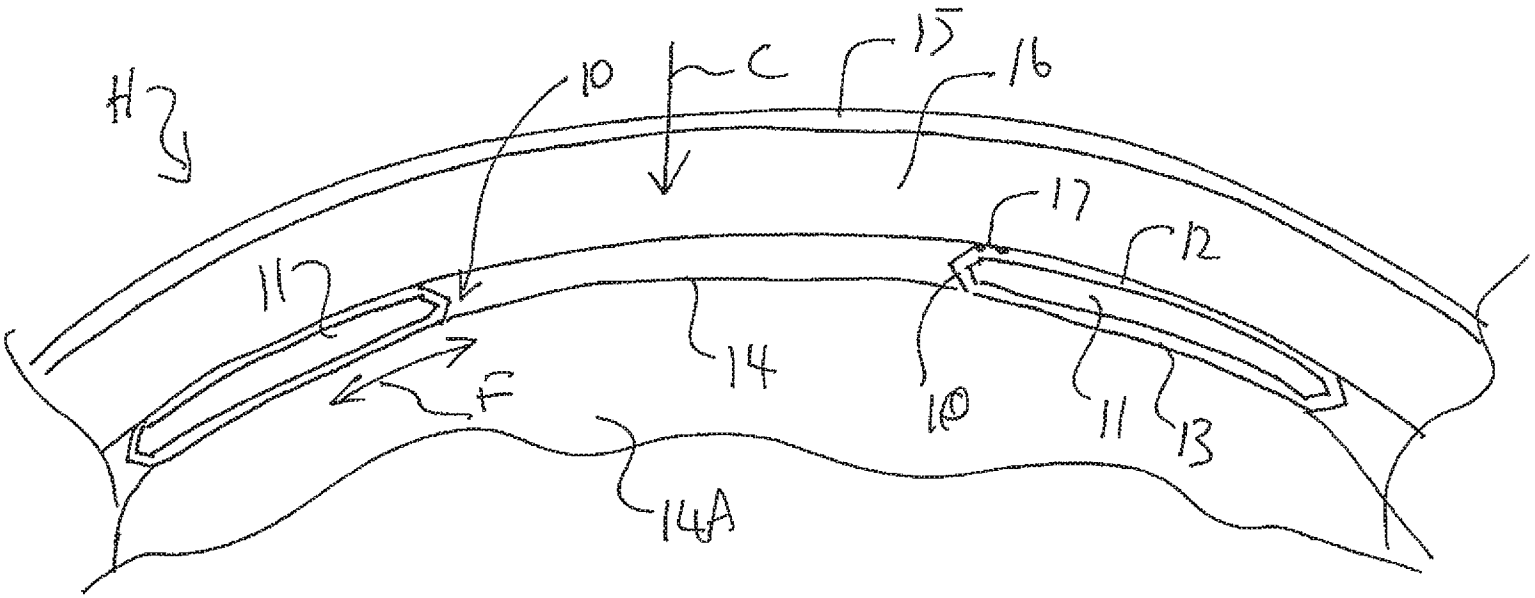
FIG. 3 is a cross-sectional view through one portion of the helmet of FIG. 1

The example provided in FIGS. 1, 2 and 3 demonstrates the use of the device in an ice hockey helmet which includes an outer shell 15 and a liner 16 of a compressible material. In this example the bladder 10 is positioned between the liner 16 and the surface 14 of the head. The device is made up of a series of flexible bladders 10 containing a low friction liquid or gel 11. This device allows the helmet including the liner and shell to move parallel to the surface 14 of the head in a controlled fashion to decrease both linear and angular acceleration of the head.

The above Mendoza patent describes a layer of gel contained between two rigid bodies designed to attenuate both compressive and angular forces acting on the head.

The arrangement described herein uses a chamber or bladder 10 with a low friction liquid or gel 11 to manage the angular forces separately from the compressive forces which are managed by the liner 16. With a gel material 11, the compressive and angular forces are managed by one material and cannot be managed separately. This is important because the angular forces F are unique and not necessarily similar to the compressive forces C requiring a method of managing the angular forces F separate from the compressive forces C.

This arrangement described herein consists of a chamber 10 filled with a substance that has high compressive characteristics and low shear characteristics. The chamber component 10 can have inner and outer walls 12, 13 which are as soft and pliable as a rubber balloon or are rigid as shown at 12A, 13A in FIG. 7 with defined structural characteristics. The chamber 10 can be designed to manage both linear and angular accelerations resulting from an impact.

The low friction liquid or gel 11 can have flow characteristics range from that of liquid soap to a thicker gel material depending on the required characteristics.

The arrangement described herein can be used in conjunction with existing technologies like foam and plastic chambers for the compressible material of the liner 16. The arrangement described herein consists of a chamber that is flexible that can be compressed or stretched into a different shape, it can be designed to have a variety of compression characteristics depending on the chamber and low friction fluid or gel like material contained within the chamber.

The low friction material 11 will create a very low shear reactive force while maintaining a high compression reactive force. This allows the energy management system to manage both the linear acceleration forces and the angular acceleration forces. It creates a system to allow the head protection device or helmet H to rotate around the head 14A at a controlled rate managing the forces to control the rate of angular acceleration of the head during the impact.

Figure 4:
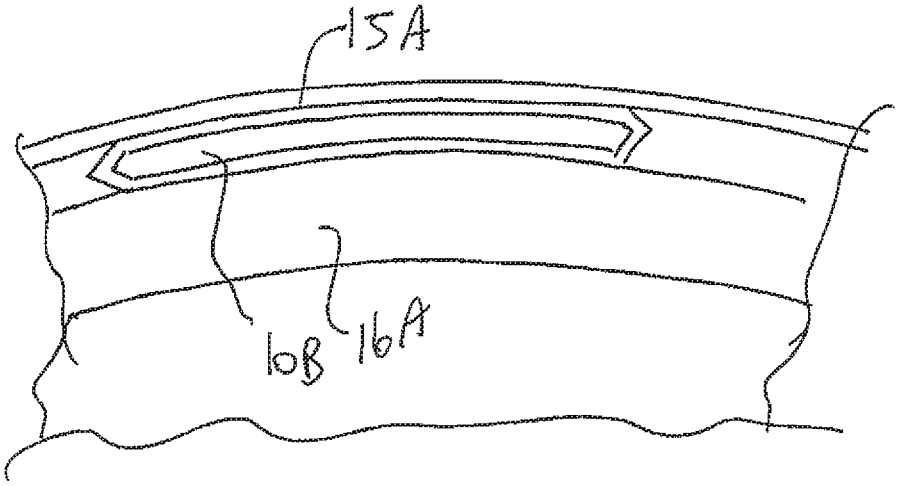
FIG. 4 is a cross-sectional view similar to that of FIG. 3 showing a first alternative embodiment.
Figure 5:
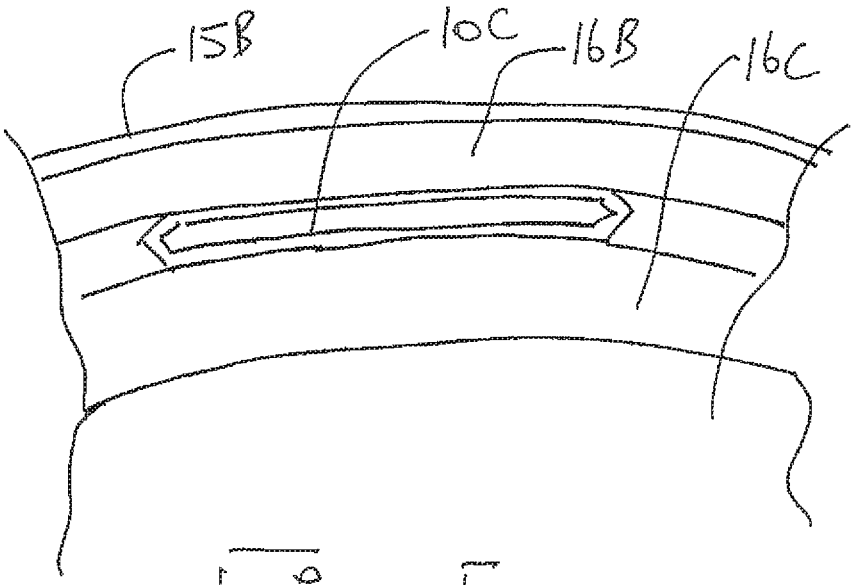
FIG. 5 is a cross-sectional view similar to that of FIG. 3 showing a second alternative embodiment.

The device controls both the linear and angular acceleration of the head during an impact to the head. It consists of a flexible chamber or bladder 10 filled with a low friction material 11 allowing the head protection or helmet H to manage both linear and angular acceleration. This device can placed in a helmet on the outside surface of the helmet. In FIG. 4 the device 10B is placed between the shell 15A and liner 16A. In FIG. 5 the device 10C is placed between two layers of liner material 16B and 16C inside the shell 15B. The device can also be placed on the inside of the liner between the skull 14A and the liner 16. The invention allows the designer to create the necessary shear characteristics to ensure the resulting linear and angular acceleration from an impact are managed to reduce the risk of a head injury.

As depicted in FIGS. 1 and 2 a hockey helmet is shown with a series of bladders 10 filled with liquid located at spaced positions around the head and located between the head and the liner 16 inside the outer shell 15 so as to manage both linear and angular forces.

The shell 15 is made up of injected polyethylene parts held together by metal screws (not shown). Between the liner material 16 and surface 14 of the head is positioned the low friction liquid filled bladders 10 designed to allow the shell and liner to rotate in a controlled manner independently of the head. The bladders 10 are made up of polyvinyl chloride (PVC) and filled with vegetable triglyceride oil. When laid flat each bladder creates an average thickness of approximately 6 mm. The bladders are anatomically shaped to follow the head and positioned at the front of the head (forehead), sides of the head (parietal), at the temple region, the back of the head (occipital) and the top of the head (crown). The bladders 10 are attached to the liner 16 using adhesive 17. The liner 16 consists of expanded polypropylene inserts that are shaped to the head and are approximately 18 mm thick. The liner 16 is fixed to the shell 15 using metal fasteners. The helmet is fitted to the head of the user and held in place using a neck strap 18. The bladders are spaced each from the next and cover only a relatively small area of the inside surface of the liner.

The bladders can also be thicker and/or cover a larger area to ensure the surface 14 of the head does not come in contact with the liner 16 which would act to decrease the effectiveness of the bladders to decrease the shear forces between the head and the liner. Thus there are provided enough bladders to ensure the surface 14 is supported on the inwardly facing surface of the bladders to allow the rotation of the helmet around the head in the controlled manner required.

As demonstrated in FIG. 3 the arrangement described herein can be used to create decreased shear forces by placing the components between different layers of the liner that is between the liner and shell or on the outer surface of the shell. Depending on the type of helmet and impact hazard the application of the components can be modified to accommodate the specific needs.

In FIG. 6 the bladder 10D is placed between the liner 16D inside the shell 15D but outside an inner head engaging surface 15E of the helmet so that the bladders are not exposed on the inside surface of the helmet.

In FIG. 8, a bladder 10F is provided which is formed by two or more stacked bladder portions 10G, 10H with one outer portion stacked on top of and attached to the inner portion.

In FIG. 9, a bladder 10J is provided which is formed by two or more bladder portions 10K, 10L connected in a row edge to edge as indicated at 10M.

The invention claimed is:

1. A helmet comprising:

an outer shell formed of a hard material and configured to distribute the force of an impact over an area;

a liner disposed inwards of the outer shell, the liner configured to absorb energy from compressive forces associated with the impact; and a component disposed inwards of the liner, such that the liner is between the outer shell and the component, and the component is configured to be between the liner and a head of a wearer during use, the component having an average thickness of approximately 6 mm, the component comprising:

a compartment containing a gel or liquid; and a wall defining the compartment, the wall comprising an inner wall and an outer wall arranged on opposite sides of the gel or liquid, the inner wall being positioned between the gel or liquid and the head, and the outer wall being positioned between the gel or liquid and the liner;

wherein the gel or liquid is configured to provide a low shear reactive force, a high compression reactive force, and low friction between inside surfaces of the component, and the inner and outer walls of the component are soft and pliable, thereby allowing the inner wall to slide relative to the outer wall in a direction generally parallel to the inner wall and the outer wall;

the component is configured such that there is low friction between the liner and the head during use, which allows the outer shell and the liner of the helmet to move in a direction generally parallel to the surface of the head during use, in order to reduce angular forces acting on the head of the wearer during use;

the helmet is configured to manage angular forces resulting from the impact independently from compressive forces resulting from the impact, such that the liner is configured to absorb energy from the compressive forces, and the component is configured to reduce angular forces acting on the head of the wearer during use, with the component not configured to absorb energy associated with compressive forces from an impact to a part of the helmet positioned radially outwards of the component.

2. The helmet of claim 1, wherein the inner wall is configured to engage the head of the wearer.

3. The helmet of claim 1, further comprising a layer of collapsible material provided adjacent to the inner layer or the outer layer.

4. The helmet of claim 3, wherein the collapsible material is a resilient foam material.

5. The helmet of claim 1, further comprising a first layer of liner material arranged on the inner side of the inner wall and a second layer of liner material arranged on the outer side of the outer wall.

6. The helmet of claim 1, wherein the component is configured to manage the rotational forces by displacement of the gel or liquid.

7. The helmet of claim 1, comprising a plurality of components configured to prevent the liner from coming into contact with the head of the wearer.

8. The helmet of claim 1, wherein the helmet comprises a plurality of components located at spaced positions around the liner.

9. The helmet of claim 1, wherein the component is attached to the liner using adhesive.

10. The helmet of claim 1, wherein the components cover a small area of liner.

11. The helmet of claim 1, wherein the helmet is configured to decrease shear forces between the helmet and the surface of the head of a wearer of the helmet during an impact to the helmet.

12. The helmet of claim 1, wherein at least one of the inner wall and the outer wall is formed from an elastic material.

13. A helmet comprising:

an outer shell formed of a hard material and configured to distribute the force of an impact over an area;

a liner disposed inwards of the outer shell, the liner configured to absorb energy from compressive forces associated with an impact; and a component disposed inwards of the liner, such that the liner is between the outer shell and the component, and the component is configured to be between the liner and a head of a wearer during use, the average thickness of the component being a third of the thickness of the liner or less, the component comprising:

a compartment containing a gel or liquid; and a wall defining the compartment, the wall comprising an inner wall and an outer wall arranged on opposite sides of the gel or liquid, the inner wall being positioned between the gel or liquid and the head, and the outer wall being positioned between the gel or liquid and the liner;

wherein the gel or liquid is configured to provide a low shear reactive force, a high compression reactive force, and low friction between inside surfaces of the component, and the inner and outer walls of the component are soft and pliable, thereby allowing the inner wall to slide relative to the outer wall in a direction generally parallel to the inner and outer walls;

the component is configured such that there is low friction between the liner and the head during use, which allows the outer shell and the liner of the helmet to move in a direction generally parallel to the surface of the head during use, in order to reduce angular forces acting on the head of the wearer during use;

the helmet is configured to manage angular forces resulting from an impact independently from compressive forces resulting from an impact, such that the liner is configured to absorb energy from the compressive forces, and the component is configured to reduce angular forces acting on the head of the wearer during use, with the component not configured to absorb energy associated with compressive forces from an impact to a part of the helmet positioned radially outwards of the component.

14. A helmet comprising:

an outer shell formed of a hard material and configured to distribute the force of an impact over an area;

a liner disposed inwards of the outer shell, the liner configured to absorb energy from compressive forces associated with an impact; and a component disposed inwards of the liner, such that the liner is between the outer shell and the component, and the component is configured to be between the liner and a head of a wearer during use, the component comprising:

a compartment containing a gel or liquid; and a wall defining the compartment, the wall comprising an inner wall and an outer wall arranged on opposite sides of the gel or liquid, the inner wall being positioned between the gel or liquid and the head, and the outer wall being positioned between the gel or liquid and the liner;

wherein the gel or liquid is configured to provide low friction between inside surfaces of the component, and the inner and outer walls of the component are soft and pliable, thereby allowing the inner wall to slide relative to the outer wall in a direction generally parallel to the inner and outer walls;

the component is configured such that there is low friction between the liner and the head during use, which allows the outer shell and the liner of the helmet to move in a direction generally parallel to the surface of the head during use, in order to reduce angular forces acting on the head of the wearer during use;

the helmet is configured to manage angular forces resulting from an impact independently from compressive forces resulting from an impact, such that the liner is configured to absorb energy from the compressive forces, and the component is configured to reduce angular forces acting on the head of the wearer during use, with the component having an average thickness of approximately 6 mm, such that the component does not absorb energy associated with compressive forces from an impact to a part of the helmet positioned radially outwards of the component.

15. The helmet of claim 14, wherein the gel or liquid is configured to provide a low shear reactive force and a high compression reactive force.

* * * * *